United States Patent [19]

Baker et al.

[11] 4,227,707

[45] Oct. 14, 1980

[54] SKI LOCKING DEVICE

[76] Inventors: Forrest E. Baker, 1891 Foxworthy Ave., San Jose, Calif. 95124; George N. Sasaki, P.O. Box 61121, Sunnyvale, Calif. 96088

[21] Appl. No.: 929,838

[22] Filed: Jul. 31, 1978

[51] Int. Cl.[2] ..... A63C 11/02

[52] U.S. Cl. ..... 280/814; 70/58

[58] Field of Search ..... 280/11.37 A, 11.37 K; 70/58, 57, 59, 62, 61

[56] References Cited

U.S. PATENT DOCUMENTS

| | | | |
|---|---|---|---|
| 3,277,676 | 10/1966 | Poehlmann et al. | 280/11.37 K X |
| 3,412,585 | 11/1968 | Berryman | 280/11.37 K X |
| 3,461,696 | 8/1969 | Seka | 280/11.37 K X |
| 3,928,990 | 12/1975 | Stenz | 280/11.37 A X |
| 3,966,219 | 6/1976 | Look | 280/11.37 A X |
| 4,011,740 | 3/1977 | Ljungberg | 280/11.37 A X |

*Primary Examiner*—Robert R. Song
*Assistant Examiner*—Milton L. Smith
*Attorney, Agent, or Firm*—Claude A. S. Hamrick

[57] ABSTRACT

A ski locking device for locking a pair of skis together in a predetermined angular relationship, the device comprising an interlockable member for attachment to one ski, another interlockable member for attachment to the other ski, and a locking mechanism carried by one of the members for locking that member to the other when the two are mated together. The interlockable members are provided with a pair of projecting portions which, when mated together, determine the angular relationship between the two locked skis.

9 Claims, 9 Drawing Figures

SKI LOCKING DEVICE

BACKGROUND OF THE INVENTION

1. Field of the Invention

This invention relates very generally to security devices and more particularly to security devices designed to discourage ski theft by locking a pair of skis together in a crossed relationship.

2. Discussion of the Prior Art

Skis are highly attractive to the common thief because they are easily stolen and have a high resale value. Skiers at ski resorts, for example, often leave their skis propped up in the snow outside the ski lodge withou taking any measures to insure their security. A would-be thief need only saunter over to the skis, pick them up as if they belonged to him, strap them onto his car ski rack and drive off. In the usual case the thief is not apprehended since his actions do not appear to be out of the ordinary.

To discourage such thefts, some ski lodges have provided ski locking racks which, for a fee, securely lock a pair of skis in place. A problem with these locking racks is that a skier is often reluctant to spend the required fee to use them if he is just going into the lodge for a short time. Furthermore, because of the often large number of skiers present at the lodges and the relatively few number of available locking racks, a skier is not always able to find an empty rack in which to secure his skis.

A number of companies and individuals have devised various different types of locks for skis. One type of lock uses a flexible steel cable which is wrapped around the ski and about a nearby stationary object, such as a tree. Such locks are, however, not particularly secure and are also quite inconvenient to carry and use.

Another type of locking device comprises a pair of mating members which are respectively attached to the upper surface of each ski. To use the locking device, the members are mated together and locked by a means of a padlock or other locking means (see U.S. Pat. Nos. 3,461,696 and 3,966,219). The mating members are usually configured so that when they engage, the skis are in a crossed position to make them more difficult for a thief to carry away and load upon a car ski rack.

A problem with prior art ski locks of this type is that they are relatively complex devices including several custom fashioned components.

Another problem with prior art ski locking devices of this type is that their construction necessitates the use of metal components. In addition to corrosion problems, when these components are exposed to the elements of wind and snow "icing" can occur which makes it very difficult to matingly engage or disengage the two members.

Yet another drawback of prior art ski locking devices is that they include recesses or crannies which can become jammed with snow, again making it difficult to engage the two members.

SUMMARY OF THE INVENTION

It is therefore an object of this invention to provide a ski locking device which is inexpensive to produce and yet is ruggedly constructed.

Another object of this invention is to provide a ski locking device which does not have recesses or crannies which readily fill with snow and that is capable of having its interlocking components constructed from materials resistant to the effects of icing.

Briefly, the preferred embodiment of the present invention comprises a first interlockable member for attachment to one ski, a second interlockable member for attachment to another ski, and a lock mechanism for releasably attaching the two interlockable members together. The two interlockable members are similarly configured and include a base plate and a pair of facing interlock portions each having a cross-sectional area that is approximately ¼ the cross-sectional area of the base plate.

One advantage of the present invention is that it is of simple construction and that it is easy to install and use.

Another advantage of the present invention is that there are no recesses or crannies which can readily fill with snow or ice to make it difficult to use.

A further advantage of the invention is that the members are so shaped that they can be formed from one of the thermoplastic materials which are highly resistant to icing.

These and other objects and advantages of the present invention will no doubt become apparent to those skilled in the art after having read the following detailed description of the preferred embodiment as accompanied by the several figures of the drawing.

IN THE DRAWING

Figure 1:
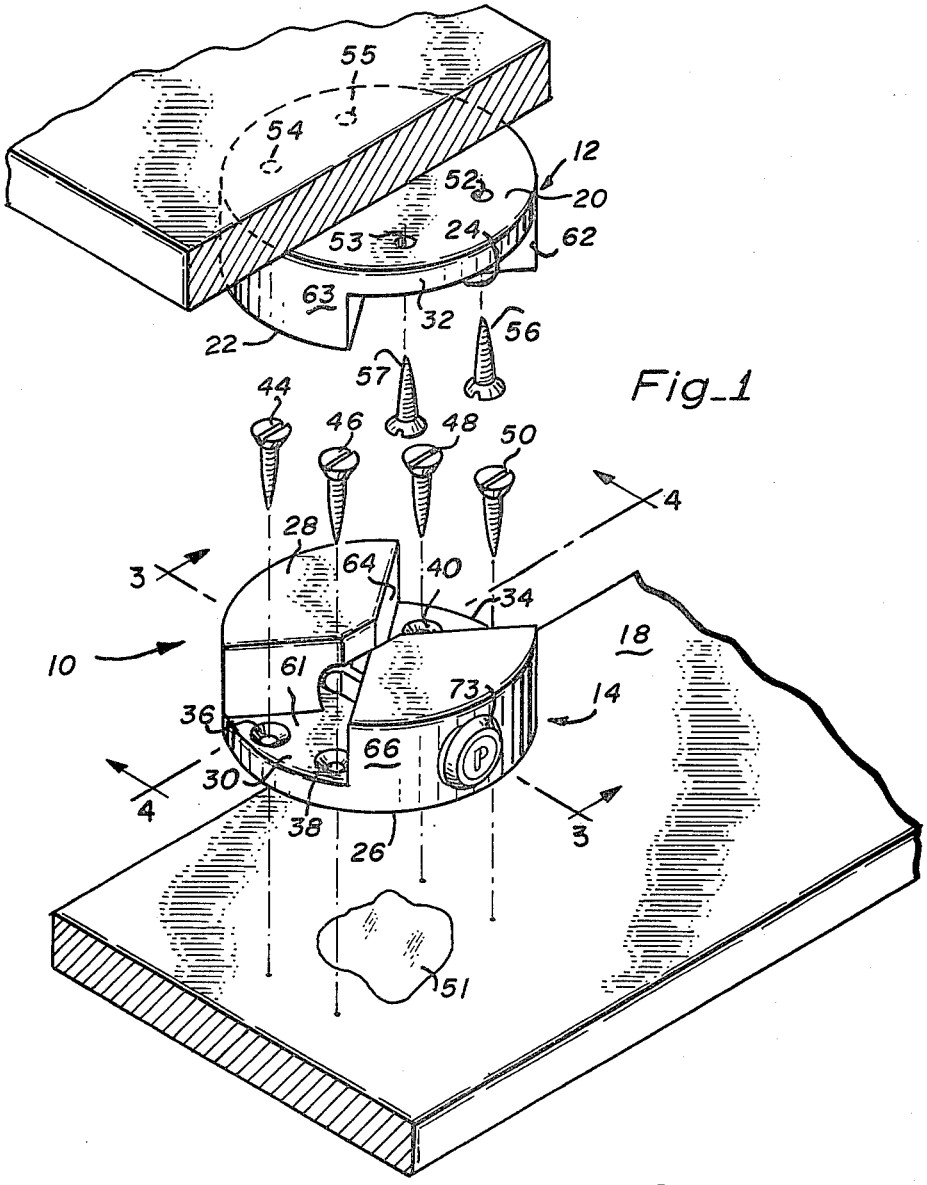
FIG. 1 is an exploded perspective view of a ski locking device and an associated pair of partically broken away skis in accordance with the present invention.
Figure 3:
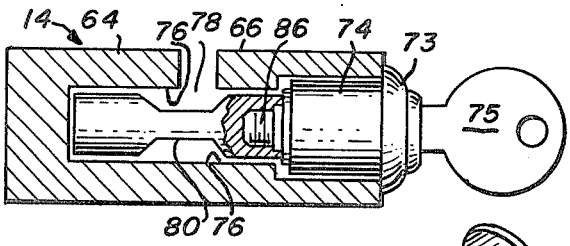
FIG. 3 is a cross-sectional view taken along line 3—3 of FIG. 1.
Figure 4A:
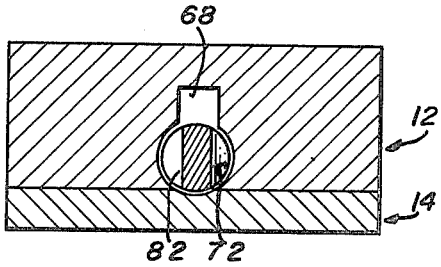
Figure 4B:
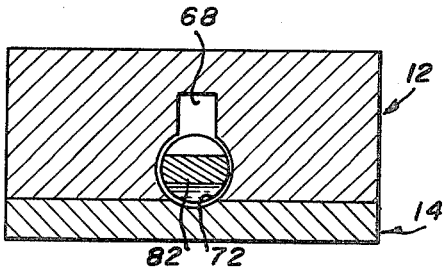
Figure 4C:
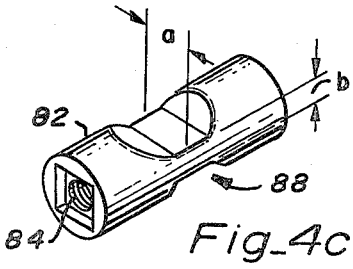

FIGS. 4*a* and 4*b* are cross-sectional views taken along line 4—4 of FIG. 1 to show unlocked positions, respectively, for a ski locking device;

FIG. 4*c* is a perspective detail of the locking pin shown in FIGS. 3, 4*a* and 4*b;*

Figure 5:
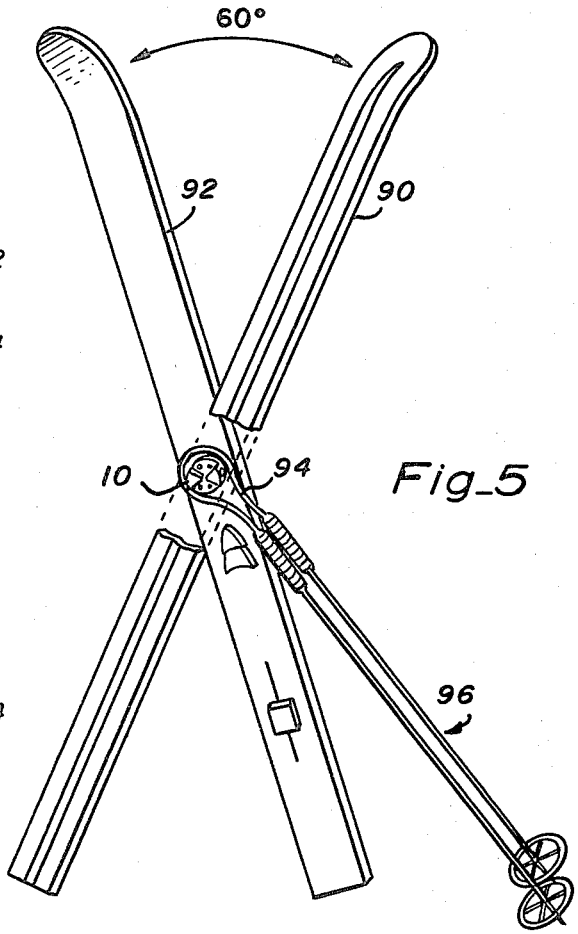
Figure 6B:
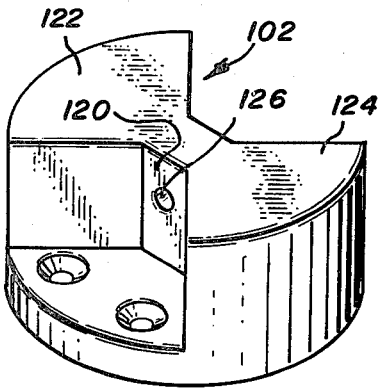
Figure 6A:
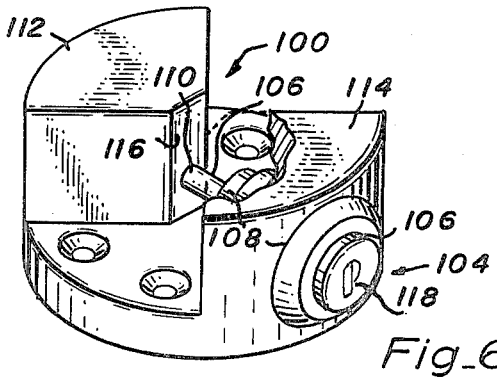

FIG. 5 is a perspective view of a pair of skis locked together by the device; and FIGS. 6*a* and 6*b* illustrate an alternate embodiment of a ski locking device in accordance with the present invention.

DESCRIPTION OF THE PREFERRED EMBODIMENT

In FIG. 1, the ski locking device 10, which includes a first interlockable member 12 and a second interlockable member 14, is shown partially exploded to better illustrate the inter-relationships between the members and a pair of skis 16 and 18 to which they are respectively attached.

Member 12 of the ski locking device includes a body having a lower end surface 20, an upper end surface 22, and an intermediate surface 24. The configuration of the body of member 14 is very similar in that it has a lower end surface 26, an upper end surface 28 and an intermediate surface 30.

Members 12 and 14 of the ski locking device are both generally cylindrical bodies having pie-shaped segments removed from the upper two thirds thereof. The portions remaining form base plates 32 and 34, respectively. In this preferred embodiment, each of the removed pie-shaped segments defines approximately a quadrant of the cylindrical body of the locking device.

Member 14 is provided with four counter sunk holes such as shown at 36, 38, and 40 through which four respective screws 44, 46, 48 and 50 are screwed into the upper surface of ski 18. An adhesive 51, such as epoxy, is often applied between surface 28 and the upper surface of the ski to provide a strong bond between the two.

In the same way, member 12 is provided with four screw holes 52, 53, 54 and 55 through which respective screws such as shown at 56 and 57 are screwed into the upper surface of ski 16.

In this preferred embodiment, the positioning of the members 12 and 14 is determined by arrowheads such as 61 which are stamped or otherwise formed on surface 24 of portion 12 and surface 30 of portion 14, respectively. When the two arrowheads are pointing directly towards the front of the respective skis, the two members of the locking device are positioned so as to interlock the skis at a mutual 60° angle.

It will be noted that by removing the pie-shaped portions from the generally cylindrical body of the two members of the ski locking device pairs of projecting interlock portions are formed. On member 12 there are two facing interlock portions 62 and 63 and on member 14 there are two facing interlock portions 64 and 66.

It may be noted that the cross-sectional area of each of the facing interlock portions is approximately one quarter the cross-sectional area of the base plate portion. This is the result of a design factor of this invention which was to provide a ski locking device having interlockable members that could, if it were desired, be produced from same mold. Consequently, the interlocking portions of members 12 and 14 should have a combined cross-sectional area equal to the cross-sectional area of the base plates. Thus, when members 12 and 14 are mated together, they cooperate to form a solid, contiguous peripheral surface which tends to improve the security of the locking device by eliminating purchase points by which the device could be rotated and also which inhibits snow or ice from entering the cracks between the two members of the ski locking device.

Note how similar in design the two portions of the ski locking device are. They may in fact, be molded in a single mold so that very little machining would need to be done to produce their final configuration. Since the members are so easily moldable, they can be constructed from a commonly used thermoplastic substance, such as ABS, which has a high resistance to icing.

Figure 2:
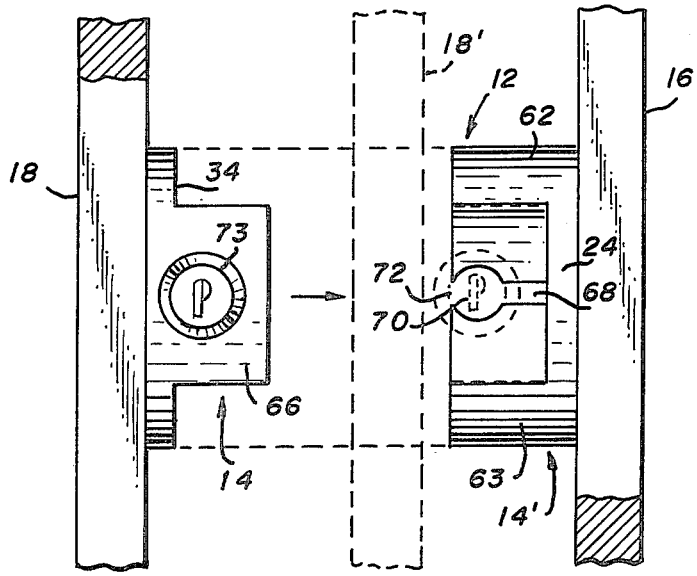
FIG. 2 is a side elevational view of a ski locking device as shown in FIG. 1.

In FIG. 2, members 12 and 14 of the ski locking device are shown in solid lines to be separated but ready for interlocking. This figure also indicates the interlocking relationship of the two members as shown at 18' by the broken line representation of member 18. As perhaps can be more clearly seen in this figure, the two members cooperate to form a solid, contiguous peripheral surface for the locking device, which in the preferred embodiment is substantially cylindrical.

A further feature of the invention is that the loops of a pair of ski poles can be placed around member 12 before interlocking it with member 14 or vice-versa. The invention can therefore provide security for a person's ski poles as well as his skis.

Referring to both FIGS. 1 and 2 it will be noted that member 12 of the ski locking device is provided with a diametrical slot 68 which extends between interlock portions 62 and 63. Formed near the upper part of slot 68 is a cylindrical bore 70 which has a small segment 72 of its circumference opening on the upper end surface of member 12.

The other member 14 of the ski locking device is provided with a bore for receiving a lock 73. When the two parts of the ski locking device are intermatingly engaged, the bore in which lock 73 resides and the bore 70 are positioned in alignment.

Details of the locking assembly and the method of operation of the locking assembly are more fully illustrated in FIGS. 3, **4*a*, 4*b* and 4*c*. In FIG. 3, which is a cross-sectional view taken along line 3—3 of FIG. 1, lock 73 (shown here with a key 75) is disposed within a lock receiving bore 74 that is formed within interlocking portion 66. Also formed in member 14 is a bore 76 which extends through interlocking portion 66 and partially through innerlocking portion 64. Formed perpendicularly to and opening on bore 76 is a diametrical slot 78 provided with a bore 80**.

Referring now to FIGS. **4*a*, 4*b* and 4*c*, it may be seen that a substantially cylindrically-shaped locking pin 82 is disposed within bore 76. Pin 82 is provided with a bore 84 which engages the end of a rotary cam 86 (see FIG. 3) of lock 73. In this preferred embodiment, the attachment of cam 86 within bore 84** comprises a tight machine press fit.

At approximately the center of locking pin 82 a narrowed section 88 is formed. The narrowed section has a first width "a" as seen from a first vantage point and a second, lesser width "b" as seen from a position 90° removed from that vantage point. It is this narrowed section 88 of the locking pin which provides for the locking and unlocking of the two members of the ski locking device.

The two functional positions of pin 82 are illustrated in FIG. **4*a* (unlocked) and FIG. 4*b* (locked). In FIG. 4*a*, the pin is rotated by turning key 75 until section 88 has the lesser dimension "b" aligned with the portion 72 of cylindrical bore 70 which opens on upper end surface 22. When in this position, parts 12 and 14** of the device can be easily separated.

To lock the device, locking pin 82 is rotated 90° from its unlocked position by turning key 75 so that portion 88 has its greater dimension "a" perpendicular to diametrical slot 68. In this position the locking pin cannot be removed from bore 70 because the width "a" of pin 82 is greater than the size of the portion 72 which opens on the upper end surface of member 12. In consequence, members 12 and 14 of the device are securely locked together and should be impossible to separate other than by picking lock 73 or by destroying the structure of the device.

In FIG. 5 a pair of skis 90 and 92 are shown locked together by a ski locking device 10 in accordance with the present invention. It will be noted that the upper surfaces of the skis are facing each other and that the lower surfaces of the skis are facing outwardly. Also, note that the loops 94 of a pair of ski poles 96 are disposed around ski locking device 10, securing the poles to the skis.

The two skis are locked together by the device 10 in a criss-crossed or angular relationship. Preferably, the angle between the front tips of the skis is approximately 60°. This angular relationship will allow the locked skis to be propped up in the snow and yet still provide protection against their being conveniently or inconspicuously carried away and loaded onto a car ski rack by an unauthorized person.

In FIGS. 6*a* and 6*b* an alternate embodiment for the ski locking device is shown. FIG. 6*a* illustrates a first interlockable member 100 which corresponds to the interlockable member 14 of the preferred embodiment and FIG. 6*b* illustrates a second interlockable member which corresponds to member 12 of the preferred embodiment. It should be noted that the rotary cylinder lock of the preferred embodiment has been replaced with a plunger type cylinder lock 104 which has a plunger 106 projecting from a body portion 108 of the lock when it is in the unlocked or open position. When the plunger is in this unlocked position, locking pin 106 is retracted from a bore 110. As in the previous embodiment, between an interlock portion 112 and an interlock portion 114 a diametrical slot 116 is formed. The retracted plunger does not extend into slot 116.

To lock the alternate embodiment device, plunger 106 of lock 104 is pressed towards body portion 108 to cause locking pin 106 to extend across slot 116 and into bore 110. To unlock the device, a key is inserted into keyhole 118 and is then turned until plunger 104 pops out into its original position. The rest of the construction of interlocking member 100 is substantially the same as that of the previous embodiment.

Similarly, the interlockable member shown in FIG. 6*b* has many features in common with the corresponding interlockable member of the preferred embodiment. However, in this embodiment, a web 120 extends between a first interlock portion 122 and a second interlock portion 124. A bore 126 of a diameter greater than that of pin 106 is formed diametrically through web 120.

To use the ski locking device of the alternate embodiment, members 100 and 102 are matingly engaged and plunger 104 of lock 106 is pressed inwardly to slide locking pin 106 through bore 126 and into bore 110. To unlock the two members, a key is inserted into keyhole 118 and turned to allow plunger 106 to "pop out" from body portion 108 of the lock and thus remove locking pin 106 from bores 110 and 126.

Although this invention has been described in terms of a couple of preferred embodiments, it is contemplated that modifications thereof will become apparent to those skilled in the art after having read the preceding detailed description. For example, the external perimeter of the interlocking members could be in other regular configurations; i.e., instead of being cylindrical it could be rectangular, diamond shaped, eliptical, or of any other symmetrical configuration which can suitably accommodate the pie-shaped interlocking portions. It is therefore intended that the following claims be interpreted as including all such modifications as fall within the true spirit and scope of the invention.

What is claimed is:

1. A ski locking device comprising:

a first interlocking member including a generally cylindrical first body having a cylindrical first base portion at one end and first and second pie-shaped interlock portions located diametrically opposite each other and extending from said first base portion along at least one half the axial length of said first body, said first body including an opening forming a communicating passageway between said first pie-shaped portion and said second pie-shaped portion;

first means for fastening said first base portion to one of a pair of skis;

a second interlocking member including a generally cylindrical second body having a cylindrical second base portion at one end and third and fourth pie-shaped interlock portions located diametrically opposite each other and extending from said second base portion along at least one half the axial length of said second body, said third and fourth interlock portions being separated by a diametrical slot extending from the top of said second base portion to the distal ends of said third and fourth interlock portions, said third interlock portion being provided with a bore including an aperture opening on said diametrical slot;

second means for fastening said second base portion to the other one of a pair of skis; and lock means disposed within said bore and including a locking pin for extending through said aperture to matingly engage said passageway when said first and second interlocking members are mated together with said first and second portions interdigitally disposed relative to said third and fourth portions, said ski locking device thereby serving to affix the two skis together at an angle relative to each determined by the angular orientation of said first and second interlocking members relative to the respective skis.

2. A ski locking device as recited in claim 1 wherein said fourth interlock portion includes another bore axially aligned with the bore in said third interlock portion and wherein said locking pin extends across said slot and into said another bore.

3. A ski locking device as recited in claim 2 wherein said passageway is formed by two spaced apart, facing surfaces having cylindrically concave surface portions, and wherein said locking pin has a central portion disposed within said slot, said central portion having a first transverse dimension larger than the smallest distance separating said concave surface portions and a second transverse dimension smaller than said smallest distance, whereby when said locking pin is in one axially rotated position said first and second interlocking members may be mated together and rotation of said locking pin to a second position causes said members to be locked together.

4. A ski locking device comprising:

a first interlocking member including a body having a first base portion adapted for attachment to the upper surface of one of a pair of skis, first and second portions which are generally wedge-shaped extending upwardly from opposite sides of said first base portion and having facing walls, the facing walls of said first and second portions and the upper surface areas of said first base portion lying therebetween defining first and second wedge-shaped recesses, and means forming a passageway communicating said first and second recesses;

a second interlocking member including a body having a second base portion adapted for attachment to the upper surface of the other of the pair of skis, third and fourth portions which are generally wedge-shaped extending upwardly from opposite sides of said second base portion, the facing surfaces of said third and fourth portions cooperating with the upper surface areas of said second base portion lying therebetween to define third and fourth wedge-shaped recesses, and means forming a second passageway communicating said third and fourth recesses; and locking means disposed within said third portion and including a locking member for extending into said second passageway and adapted to mate with said first passageway when said first and second interlocking members are mated together with said first and second portions received within said third and fourth recesses and said third and fourth portions received within said first and second recesses thereby causing the two skis to be locked together at a predetermined angular relationship determined by the angular orientation of said first and second interlocking members to the respective skis.

5. A ski locking device as recited in claim 4 wherein said third and fourth interlock portions include axially aligned bores and said locking member extends from one of said bores across said second passageway and into the other of said bores.

6. A ski locking device as recited in claim 5 wherein said first passageway is formed by two spaced apart, facing surfaces having cylindrically concave surface portions, and wherein said locking member has a central portion disposed within said second passageway, said central portion having a first transverse dimension larger than the smallest distance separating said concave surface portions and a second transverse dimension smaller than said smallest distance, whereby when said locking member is in one axially rotated position said first and second interlocking members may be mated together and rotation of said locking member to a second position causes said interlocking members to be locked together.

7. A ski locking device comprising:

a first interlocking member including a first base adapted for attachment to the upper surface of one of a pair of skis and having a perimeter of a particular size and configuration, and a first pair of opposing pie-shaped interlock portions projecting upwardly from said first base portion;

a second interlocking member including a second base portion adapted for attachment to the upper surface of the other of the pair of skis and having a perimeter of said particular size and configuration, and a second pair of opposing pie-shaped interlock portions projecting upwardly from said second base portion, said first and second interlocking members being adapted to be mated together with said first and second pairs of interlock portions interdigitally related to each other; and means for locking said first interlocking member to said second interlocking member when the two are mated together, whereby said skis are locked together at a predetermined angle relative to each other determined by the angular orientation of said first and second interlocking to the respective skis.

8. A ski locking device as recited in claim 7 wherein said first pair of interlock portions are spaced apart from each other to form a passageway therebetween, said second pair of interlock portions are spaced apart from each other to form a slot therebetween, wherein said second pair of interlock portions includes axially aligned bores, and wherein said means for locking includes a pin which extends from one of said bores across said slot and into the other of said bores.

9. A ski locking device as recited in claim 8 wherein said passageway is formed by two spaced apart, facing surfaces having cylindrically concave surface portions and wherein said pin has a central portion disposed within said slot, said central portion having a first transverse dimension larger than the smallest distance separating said concave surface portions and a second transverse dimension smaller than said smallest distance, whereby when said pin is in one axially rotated position, said first and second interlocking members may be mated together, and rotation of said pin to a second position causes said members to be locked together.

* * * * *